United States Patent [19]

Beckerman et al.

[11] Patent Number: 4,776,459

[45] Date of Patent: Oct. 11, 1988

[54] BAKERY FOODS PACKAGE

[75] Inventors: Kenneth Beckerman; Stuart Beckerman; Russell D. Owen, all of Pittsburgh, Pa.

[73] Assignee: Package Products, Inc., Pittsburgh, Pa.

[21] Appl. No.: 948,363

[22] Filed: Dec. 31, 1986

Related U.S. Application Data

[63] Continuation-in-part of Ser. No. 730,080, May 3, 1985, abandoned.

[51] Int. Cl.[4] ..... B65D 25/00

[52] U.S. Cl. ..... 206/45.32; 206/45.34; 206/551; 229/906; 229/128; 229/155

[58] Field of Search ..... 206/45.31, 45.32, 45.34, 206/464, 465, 482, 551, 467; 229/2.5 R, 43, 45 R, 45 EC

[56] References Cited

U.S. PATENT DOCUMENTS

| | | | |
|---|---|---|---|
| Re. 28,059 | 7/1974 | Mounts et al. | 206/464 |
| 2,579,354 | 12/1951 | Zelt | 229/45 R |
| 2,637,617 | 5/1953 | Stotter | 312/284 |
| 2,833,405 | 5/1958 | Del Nero | 206/78 |
| 3,066,824 | 12/1962 | Bostrom | 220/315 |
| 3,101,881 | 8/1963 | Crane | 229/45 R |
| 3,244,355 | 4/1966 | Nolen | 229/45 R |
| 3,351,188 | 11/1967 | Vajtay | 206/45.34 |
| 3,371,848 | 3/1968 | Ward et al. | 229/45 |
| 3,556,387 | 1/1971 | Trimble | 229/45 EC |
| 3,690,902 | 9/1972 | Dahl | 99/172 |
| 3,767,110 | 10/1973 | Congleton | 229/45 |
| 3,795,360 | 3/1974 | Bianchi et al. | 229/43 |
| 3,797,730 | 3/1974 | Zach | 229/43 |
| 3,815,736 | 6/1974 | Sedlak | 206/501 |
| 3,847,299 | 11/1974 | Page | 220/4 F |
| 3,902,628 | 9/1975 | Schurman | 220/306 |
| 3,937,326 | 2/1976 | Schick | 206/465 |
| 3,938,726 | 2/1976 | Holden, Jr. et al. | 229/2.5 R |
| 4,061,241 | 12/1977 | Retelny | 220/4 B |
| 4,079,880 | 3/1978 | Edwards | 229/45 R |
| 4,096,986 | 6/1978 | Florian | 229/2.5 R |
| 4,098,453 | 7/1978 | Arneson | 229/45 |
| 4,193,496 | 3/1980 | Barratt | 206/380 |
| 4,197,940 | 4/1980 | DeRossett | 206/45.32 |
| 4,375,862 | 3/1983 | Kurinsky et al. | 220/293 |
| 4,452,356 | 6/1984 | Dahl | 206/45.32 |

FOREIGN PATENT DOCUMENTS

| | | | |
|---|---|---|---|
| 662471 | 5/1963 | Canada | 206/465 |
| 106874 | 3/1943 | Sweden | 229/45 R |

*Primary Examiner*—David T. Fidei

*Attorney, Agent, or Firm*—Arnold B. Silverman

[57] ABSTRACT

A bakery food package for releasably and securely holding cakes, pies and other baked goods. The package includes a base for supporting the bakery goods and a cover secured to the base. The base has a plurality of circumferentially spaced second locking elements removably engaged with a plurality of first locking elements which are formed on the cover. The cover has a top wall, depending sidewalls and a generally outwardly projecting lower flange. In one preferred embodiment of the package, the second locking element may be generally upwardly and inwardly rotated along a pivotal axis in order to permit portions of the first locking elements to pass therethrough and engage the same. Portions of the outwardly projecting lower skirt of the cover member extend downwardly to resist free relative sliding and rotating movement between the cover member and base. The base may be corrugated board and may be provided with an upper foil layer. The base may serve as both a portion of the container and as a cake plate for use in serving or decorating the cake or other baked goods. In another preferred embodiment of the invention, the second locking elements include two hinges or pivotal axes about which portions of the second locking elements rotate. The inclusion of two hinges or pivotal axes facilitates easy and more secure relative locking between the cover and base. In a preferred form the hinges operate sequentially.

16 Claims, 5 Drawing Sheets

BAKERY FOODS PACKAGE

CROSS REFERENCE TO RELATED APPLICATION

This Application is a Continuation-in-Part of U.S. application Ser. No. 06/730,080, filed May 3, 1985 and entitled "Bakery Foods Package".

BACKGROUND OF THE INVENTION

1. Field of the Invention

This invention relates to packages for bakery foods and, more specifically, it relates to an improved package of this type which may readily be locked and unlocked without destruction of the packaging components.

2. Description of the Prior Art

The need to provide an efficient, secure and sanitary package for baked goods such as cakes, pies and the like has long been recognized. The need is particularly acute with respect to packages which are to contain the bakery foods on retail merchants' shelves. Among the specific needs are the need to preserve the integrity of the package so that consumers may not improperly gain access to the food products, the need to provide visibility for the product in order to give the consumer a better idea as to the nature and quality of the goods and the further objective, particularly in respect of cakes, to permit opening, and easy and secure relocking, of the container by authorized personnel such as when it becomes desirable to custom decorate the cake for a particular purchaser.

Numerous prior packages consisting of a base portion and a cover have been known for use in connection with bakery products It has been known, for example, to provide a plastic dome cooperating with a plastic base in a snap fit relationship. One of the difficulties in connection with such packaging has been the problem of determining visually whether the package is in fact in a locked condition. Often bakery personnel have secured the cover to the base by securing a wrap of clear plastic film thereover to augment the cover-base lock. Also, frequently it has been difficult to unlock such packages without risk of damaging or dropping the contents. Damage often occurs when the cover is removed at an angle, rather than vertically from the base.

It has also been known to employ separate locking means to secure a cover to a base in connection with bakery packaging. For example, it has been known to employ adhesive for such purposes. One of the problems with adhesive is the lack of certainty that a firm joint has been established. Also adhesive joints may be adversely affected by refrigeration or freezing. Misplaced reliance on the integrity of the joint can result in dropping of the contents rendering them contaminated. It has also been known to employ clip members to secure a cover to a base. These require handling of separate elements and have not always provided the desired intimacy of securement.

It has also been known to employ tape to secure the cover to the base. Such tape is not suited, however, for effective reclosure and is generally considered to be unattractive.

U.S. Pat. Nos. 2,833,405; 3,351,188 and Canadian Patent 662,471 all disclose packages which, while not bakery packages per se, incorporate projecting tab members which are received in thin, slit openings for locking portions of the packages together.

U.S. Pat. No. 3,690,902 discloses a cake package wherein a transparent ribbed cover member is secured to a base by means of staples. One of the problems with this type of package is the need to employ separate securing means, the need to use an implement to open the package and the hazard that one or more staples may inadvertently be mingled with or enter into the food product, thereby creating a hazard for the user.

U.S. Pat. No. 3,767,110 recites a carton with hinge latch closure. That carton includes a locking tab, rotatable on two axes, which is formed at the top edge of a bowl-shaped bottom member. The locking tab cooperates with a locking well formed in the carton's lid and the lid, bottom member and locking tab all form one integral unit. As the item enclosed within the package is clamped between the interior surfaces of the lid and bottom, such a package would be undesirable for bakery food storage as contact between the package and bakery product would tend to damage delicate and artistic icing and the like. Additionally, the carton incorporates a hinge which connects the lid and bottom member, thereby necessitating angular, and not vertical, opening of the lid from the cover.

U.S. Pat. No. 3,795,360 discloses a cover for a basket-type container for holding agricultural products which includes a top and depending flexible sidewalls. The cover and basket include cooperative locking means which are engaged and disengaged by flexing the cover sidewalls. That arrangement is undesirable with respect to bakery products as flexing of the cover sidewalls risks contact between the enclosed product and the sidewalls which may result in damage to decorative icing.

U.S. Pat. No. 3,937,326 discloses a product display carton. In one embodiment, the base of that carton incorporates fold-up edges which define a product receiving portion and which form openings for the receipt of tongues which depend from the carton's cover. A second embodiment of that patent discloses a base with fold-up lobes which rotate one a single axis. In the first embodiment, the fold-up edges limit the visibility of the product within the carton.

There remains, therefore, a very real and substantial need for an improved bakery foods package which will eliminate or minimize the above-described problems.

SUMMARY OF THE INVENTION

The present invention has met the above-described need. It employs cooperating base and cover members which each have a plurality of circumferentially spaced locking elements. In one preferred embodiment, the cover has a top wall, depending sidewalls, which may be ribbed for reinforcement purposes, and a lower generally outwardly projecting flange, a portion of which projects downwardly to resist free relative sliding between the cover and the base members. A plurality of first locking means are formed on or adjacent to the lower flange.

The base has a plurality of circumferentially spaced second locking elements which may be integrally formed with the base in the preferred embodiment and are adapted to rotate generally upwardly and inwardly on one axis to permit the first locking means to extend through an opening therein to thereby removably secure the cover to the base. The locking elements securely retain the package in locked condition and yet may be unlocked so as to permit access to the bakery foods inside.

A second embodiment of the invention provides a base with second locking elements that rotate on two separate axes. That arrangement facilitates effective relative engagement of the first locking means and second locking elements and provides additional locking integrity between the cover and the base.

In both embodiments, preferably the base is so proportioned that the second locking elements will generally project radially outwardly farther than other portions of the base when in unlocked position. A foil layer, such as an aluminum foil layer, for example, may be secured to the upper surface of the base which may be composed of corrugated board.

It is an object of the present invention to provide a bakery foods package which is economical to manufacture and use.

It is a further object of the present invention to provide a bakery food package which contains integrally formed locking elements which will securely retain the package in locked condition while permitting unlocking for desired access to the contents.

It is another object of the present invention to provide such a locking system in a bakery foods package which avoids the need to use independent locking means and also eliminates the risk of locking means providing an added source of potential food contamination.

It is a further object of the present invention to provide such a locked container which is easy to open and easy to close without damage to the locks.

It is a further object of the present invention to provide such a locked container wherein the base may also function as a cake serving plate.

It is another object of this invention to provide a locking system for a bakery foods package which will provide obvious visual means for determining whether the package is locked and will permit straight, vertical removal of the cover from the base.

It is another object of this invention to provide a package base which may be employed as a cake decorating support.

It is yet another object of the present invention to provide a bakery foods package wherein the locking means effectively reduce the likelihood of inadvertent opening of the package.

These and other objects of the invention will be more fully understood from the following description of the invention on reference to the illustrations appended hereto.

DESCRIPTION OF THE PREFERRED EMBODIMENT

Figure 1:
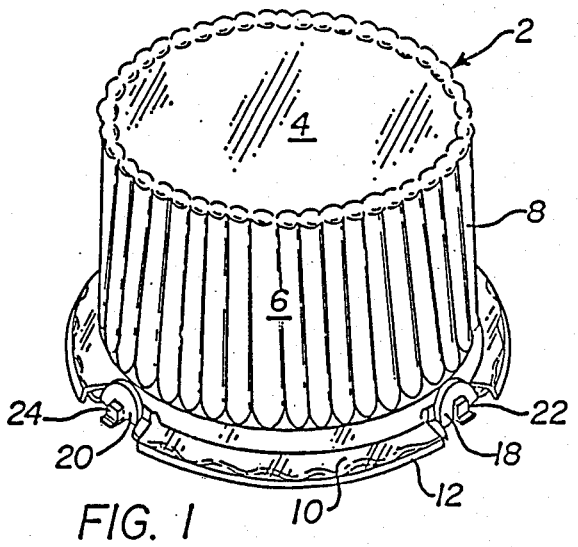
FIG. 1 is a perspective view of a form of the package of the present invention.
Figure 3:
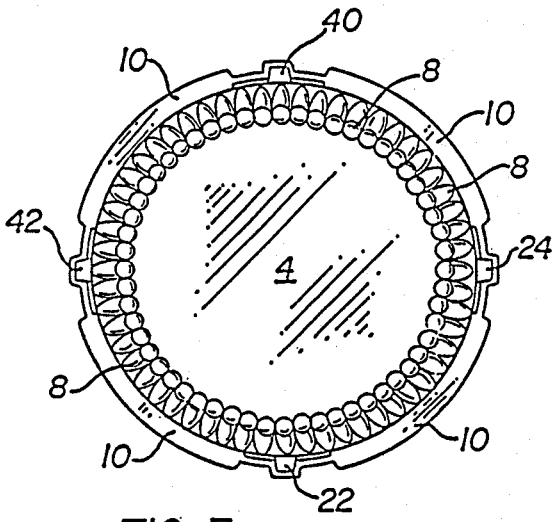
FIG. 3 is a bottom plan view of the cover of FIG. 1.

Referring to FIGS. 1 through 7 there is shown a cover member 2 in the nature of a dome which is preferably transparent. The dome may advantageously be made as a unitary article formed from a resinous plastic material. The cover 2 has a generally planar top wall 4, an annular depending sidewall 6 which contains a plurality of stiffening ribs 8. A generally radially outwardly projecting flange 10 terminates in a generally downwardly projecting flange extension 12. A plurality of female locking members 18, 20, 26 and 28 are formed generally coplanar with base 30, but are rotated generally upwardly and inwardly in order to permit the male locking means 22, 24, 40 and 42 to be passed at least part way through the opening in the female locking elements and lockingly engage the same.

It is preferred that the female locking elements 18, 20, 26 and 28 and the male locking means 22, 24, 40 and 42 be circumferentially spaced about equidistant from the next adjacent similar element on either side and that they be circumferentially positioned so as to mate when the assembly is established. The integrally formed ribs 8 serve to stiffen the cover 2.

Figure 2:
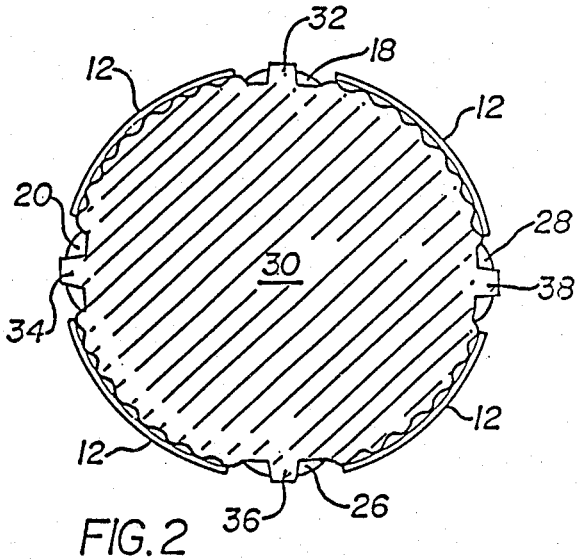
FIG. 2 is a bottom plan view of the package of FIG. 1.
Figure 4:
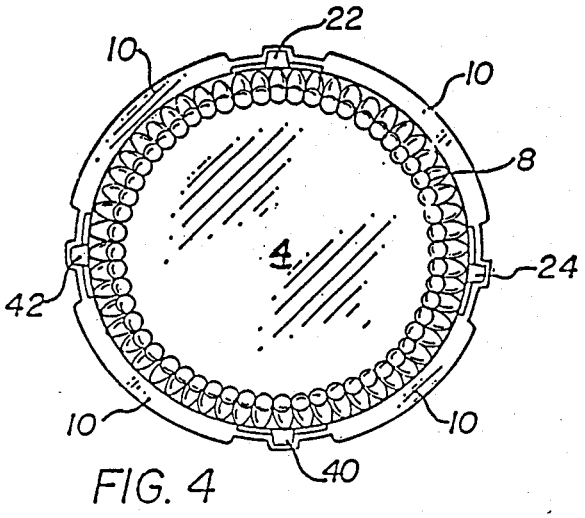
FIG. 4 is a top plan view of the cover employed in FIG. 1.
Figure 5:
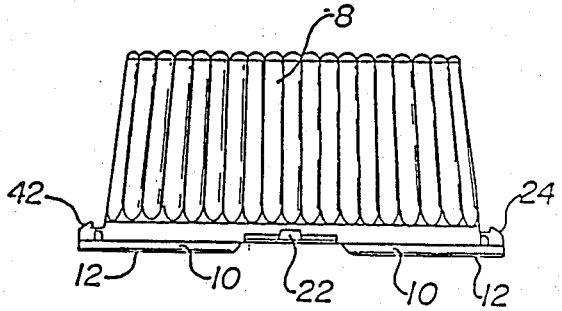
FIG. 5 is a front elevational view of the cover employed in FIG. 1.

It will be appreciated that, by this locking system, the container is firmly mechanically locked and obviously locked while permitting ready opening by vertical removal of the cover should it be desired to gain access to the contents. The portion of the base 30 from which the opening in the female locking members has been formed remains substantially coplanar with the base 30 in the form of tabs 32, 34, 36 and 38 (FIG. 2). There is also provided a ready visual indication of whether the package is locked.

Figure 6:
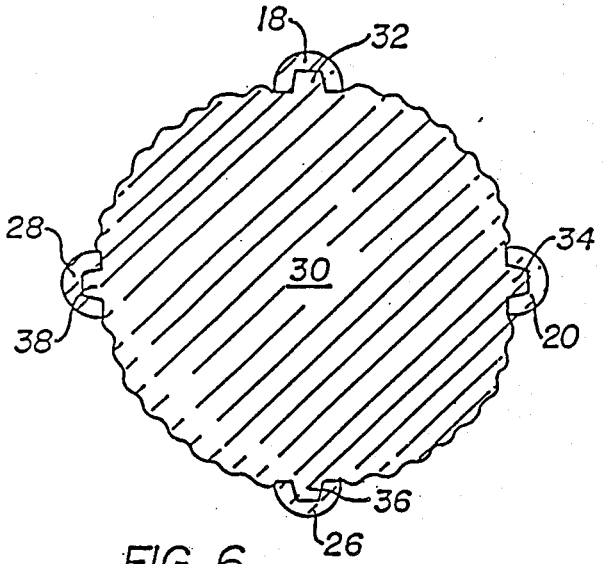
FIG. 6 is a top plan view of the base of FIG. 1.
Figure 7:
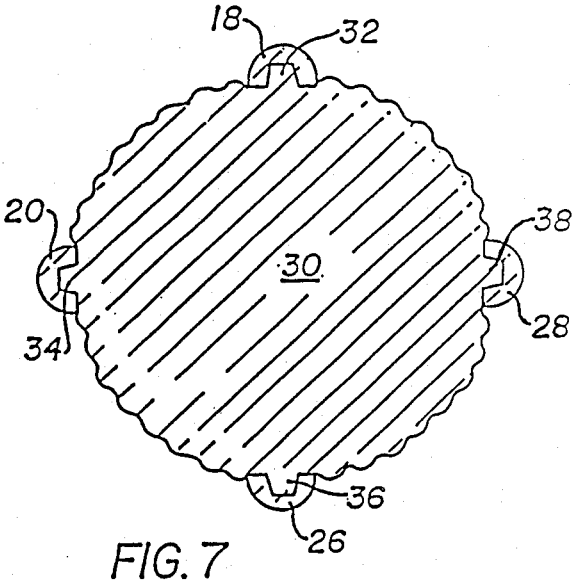
FIG. 7 is a bottom plan view of the base of FIG. 1.

In effecting locking of the container with bakery foods contained therein, one need merely place the cover 2 on the base 30 and rotate the female locking elements 18, 20, 26 and 28 upwardly until they are engaged with the respective male locking means 22, 24, 40 and 42. In this position, the female locking elements are generally vertically oriented. Details of the prefered configuration for the base are shown in FIGS. 6 through 8.

Figure 8:
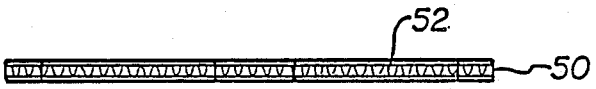
FIG. 8 is an elevational view of the base of FIG. 1.
Figure 9:
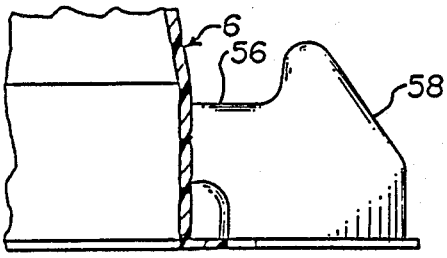
FIG. 9 is a fragmentary view partially in section showing a lower portion of the cover member of the present invention.
Figure 10:
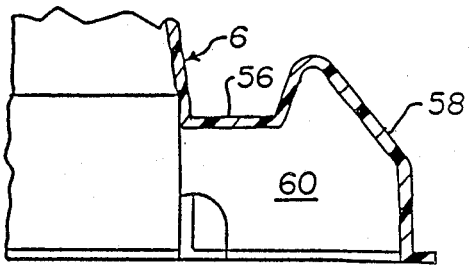
FIG. 10 is an additional cross-sectional view showing a portion of the cover of the present invention.
Figure 11:
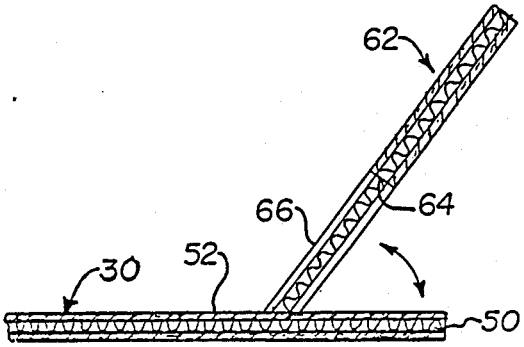
FIG. 11 is an illustration of a portion of the base member of the present invention.

As shown in FIG. 8, the base may be made of a corrugated board material 50, and include an overlying layer of metal foil 52 for decorative as well as functional purposes, or may be made of other suitable materials such as plastic, for example. It will be appreciated that the foil may be sufficiently attractive as to permit the base to be employed not only as a package base, but subsequently as a cake serving plate. Also, the flatness of the base permits it to be used as a cake circle for decorating, thereby eliminating the need for a separate cake circle.

In order to enhance the locking action, it is preferred that the male locking means be provided with an enlargement to resist inadvertent opening of the lock. As is shown in FIGS. 9–12, the male locking means has a first portion 56 projecting generally radially outwardly and an upwardly projecting portion 58, both of which cooperate to define an underlying hollow 60. In locking the assembly, the female locking elements are rotated upwardly until element 58 passes substantially completely through the opening 66, of the female locking element, (FIG. 11) thereby permitting the inner portion of boss or enlargement 58 to engage top edge 64 of opening 66 of the female locking element 62. When it is desired to reverse the locking action, one merely need grab portion 62 and effect a downward rotating motion.

Figure 13:
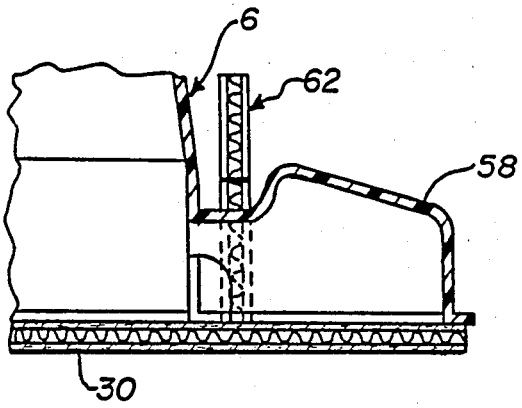
FIG. 13 is a partial cross-sectional illustration showing details of the interlocking relationship.

The relationship between the male locking members 22, 24, 40 and 42 and the cooperating female locking member may be such that the female member 18, 20, 26 and 28 will be generally vertically oriented in the locked position so as to provide a more positive indication that the package is locked as is shown in FIG. 13.

While this preferred embodiment of the invention employs four pairs of locking elements, such as have been illustrated in the drawings, it will be appreciated that other numbers of such elements may be employed. In general, it will be preferred to employ a series of at least two pairs of such locking elements which are spaced equidistant from each other about the circumference.

Figure 12:
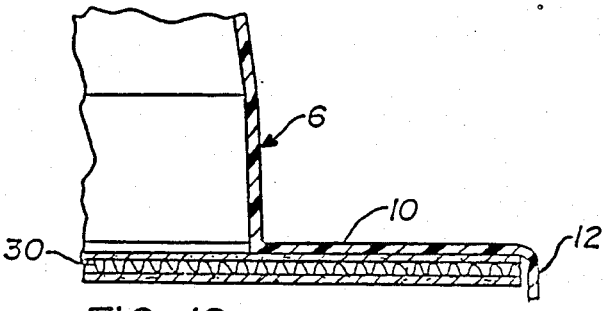
FIG. 12 is a partial cross-sectional illustration showing a portion of the cover engaged with a portion of the base.

Referring further to FIGS. 1 and 12, it will be seen that the downward extension 12 of radial flange 10 extends, in a preferred form, below the upper surface of base 30. This flange serves to resist undesired relative sliding movement between the cover 2 and the base 30 to facilitate locking. Similarly, the interlocking action between the female locking elements and male locking means substantially prevents relative sliding and free rotational movement between the cover 2 and the base 30. The extension 12 of flange 10 is cut away in order to allow protrusion of the female locking elements. Placing the cutaways over the female locking means facilitates indexing the cover 2 with respect to the base 30.

While in the hereinabove described embodiment, female locking members 18, 20, 26 and 28 have been shown as being on the base 30 and male locking members 22, 24, 40 and 42 have been shown as being on the cover 2, the reverse arrangement may be employed. If desired, the male members may be formed in the base and the cooperating female members may be formed on the cover. Also, a mixture having some male locking members and some female locking members on the cover and the respective cooperating members on the base may be employed.

Figure 14:
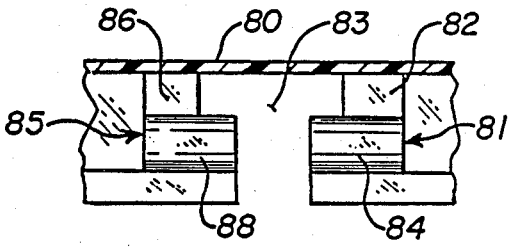
FIG. 14 is a top plan view of a modified form of first locking means.
Figure 15:
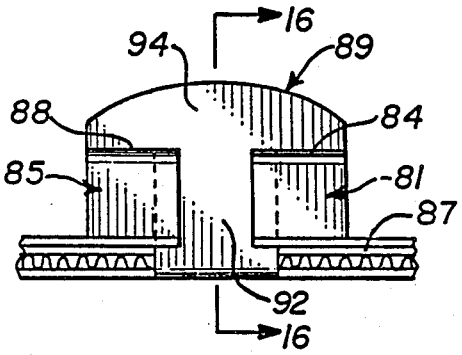
FIG. 15 is a fragmentary elevational illustration of the locking means of FIG. 14 in combination with a form of second locking means.
Figure 16:
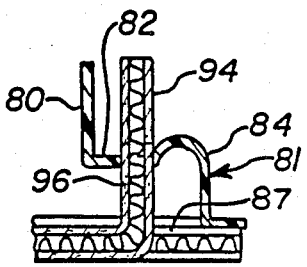
FIG. 16 is a cross-sectional illustration of the locking means of FIG. 15 taken through 16—16.

In the form shown in FIGS. 14 through 16, the cover sidewall 80 has female locking means established by relatively spaced integrally formed radially projecting hollow bosses 81 and 85 which define gap 83. Boss 81 has a rear portion 82 and a transversely enlarged forward portion 84. Similarly boss 85 has a rear portion 86 and a transversely enlarged forward portion 88. Male locking means 89 is integrally formed with base 87 and is of generally T-shape. It has an enlarged head 94 and a connecting portion 92. In locked position, connecting portion 92 is received within space 83 and enlarged head 94 engages, respectively, the rear portions 82, 86 of bosses 81 and 85, respectively. Enlarged portions 84 and 88 provided a restricted throat which assists with male locking portion retention.

Figure 17:
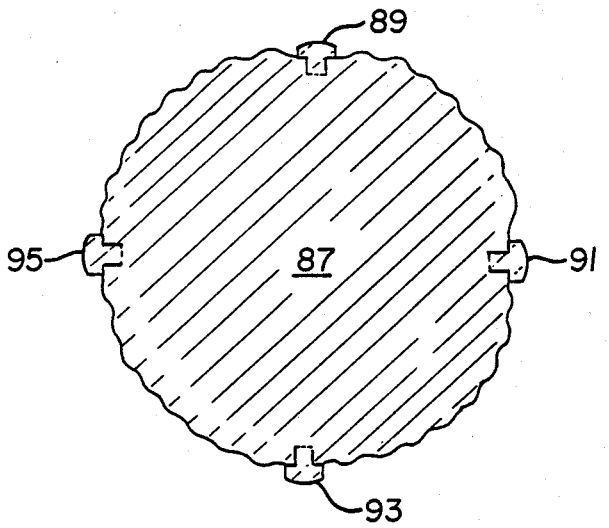
FIG. 17 is a top plan view of a base employed in FIGS. 14–16.
Figure 18:
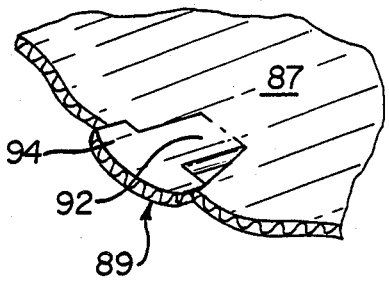
FIG. 18 is a fragmentary view of a portion of the base of FIG. 17.
Figure 19:
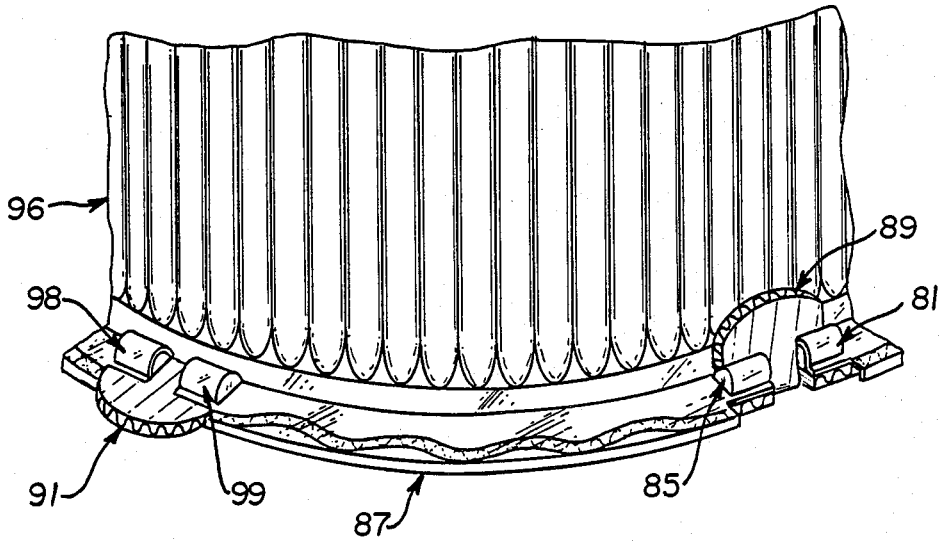
FIG. 19 is a fragmentary perspective view of a cover and base of the type used in the embodiment of FIGS. 14–18.
Figure 20:
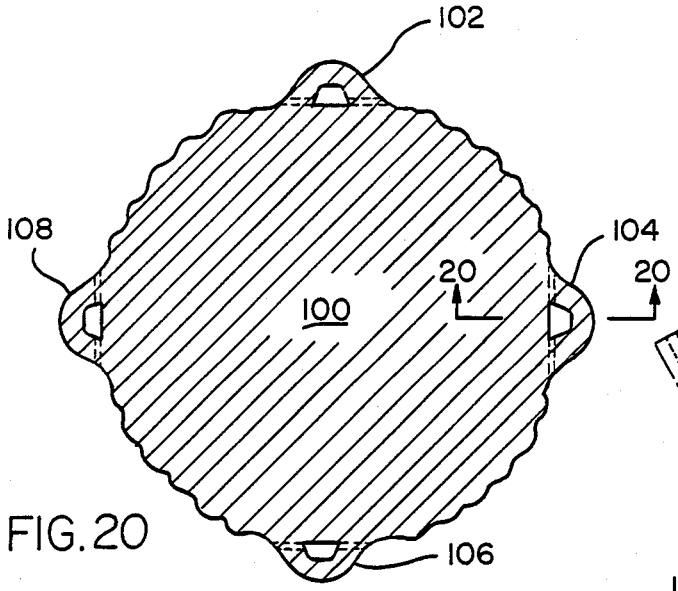
FIG. 20 is a top plan view of a second embodiment of a base employing female locking elements, each with two pivotal axes.

Referring to FIGS. 17 through 19, there is shown a base member 87 which has a plurality, of integrally formed male locking members 89, 91, 93, 95 which project generally radically outwardly therefrom, male locking member 89 is shown in FIG. 18 in a partially upwardly rotated position.

In FIG. 19, cover 96 is shown in overlying contacting relationship with respect to base 87. Male locking member 89 is shown in locked relationship with female locking member defining bosses 81, 85, male locking element 91 is shown in unlocked position with respect to bosses 98, 99.

FIGS. 20–24 show an alternate preferred embodiment of the bakery foods package, which employs female locking elements with two, rather than one, pivotal axes. Package base 100, shown in FIG. 20, incorporates four female locking elements, 102, 104, 106 and 108, which are preferably generally evenly circumferentially spaced.

Figure 21:
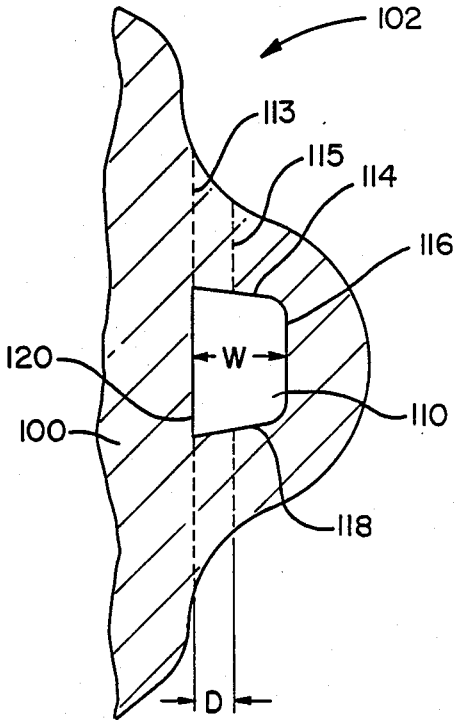
FIG. 21 is a top plan view of one of the locking elements of the base of FIG. 20.

FIG. 21 shows a detailed view of female locking element 102. Opening 110 of female locking element 102 is defined by cutting through the base material along lines 114, 116, 118 and 120 and completely removing the enclosed portion of the material. Although it would be possible to form opening 110 by cutting along only lines 114, 116 and 118, thereby leaving the material attached to base 100 along line 120, the complete removal of the material is preferable. By not completely removing the enclosed material, the resultant scraping between the unremoved material and locking element 102, along lines 114, 116 and 118, when female locking member 102 is pivoted from unlocked to locking position, may cause undesired resistence to free movement of locking member 102. Also, such removal can enhance efficiency of the hinging action. Female locking elements 104, 106 and 108 are formed in the same manner as element 102.

Female locking element 102 also includes two hinges on pivotal axes 113 and 115. Preferably, axes 113 and 115 are defined by scoring female locking element 102 along two generally parallel lines. Pivotal axes 113 and 115 are separated by a distance, D, which is preferably equal to about ½ the width, W, of opening 110. Line 116 defines a top edge which engages a portion of the cover's male locking element for secure locking action.

Figure 22:
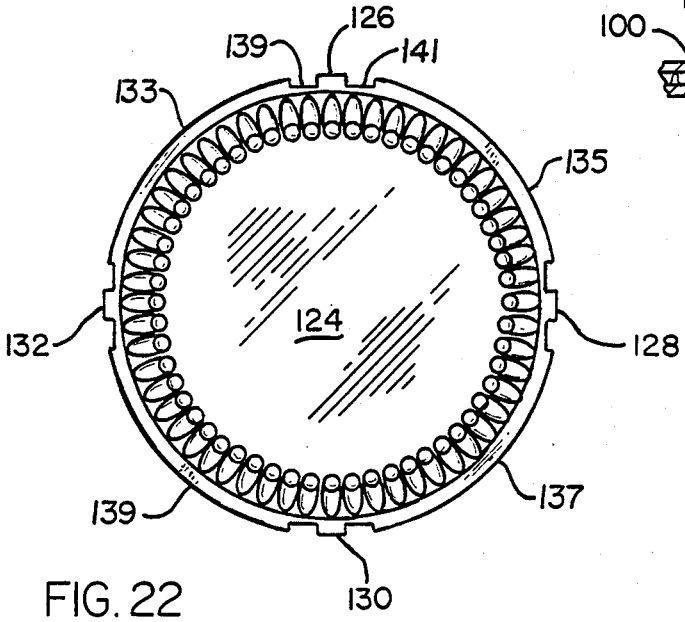
FIG. 22 is a top plan view of a second embodiment of a cover.

FIG. 22 shows cover 124 which, in the depicted embodiment, employs four generally evenly circumferentially spaced male locking elements, 126, 128, 130 and 132, which cooperate with the female locking elements of base 100 (FIG. 17). Cover 124 includes flange sections 133, 135, 137, 139 which project generally radially outwardly from cover 124 and terminate in a generally downward direction similar to that of FIG. 12. Those flange portions resist undesired relative sliding motion between cover 124 and base 100. Additionally, as flange portions 133, 135, 137, 139 are adjacent to the female locking elements 102, 104, 106 and 108 of base 100 (FIG. 20) when cover 124 is placed on base 100, both relative rotational and sliding movement between cover 124 and base 100 are thereby resisted.

Figure 24:
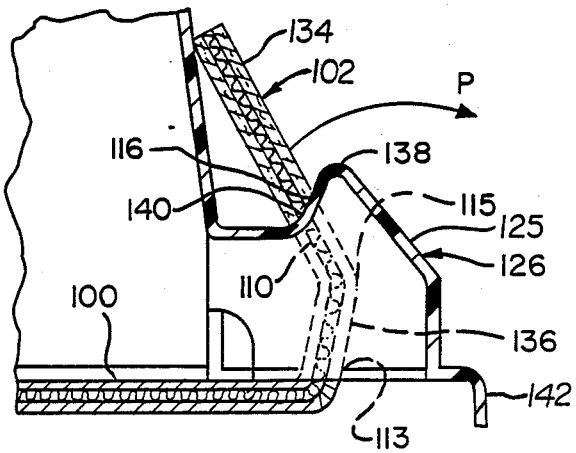
FIG. 24 is a partial cross-sectional illustration showing details of the interlocking relationship between the base of FIG. 20 and the cover of FIG. 22.

Adjacent the sides of male locking element 126 are flange portions 139 and 141. These flange portions preferably extend radially outward in a generally horizontal direction and do not terminate in a downwardly projecting flange segment as do flanges 133, 135, 137, 139. Also these flanges 139, 141 preferably have edges which are straight and oriented generally perpendicularly with respect to a radius drawn from the center of the cover 100 to the edge. This configuration tends to stiffen the portion of cover 124 in the vicinity of locking element 126, thereby adding structural integrity to cover 124. As is shown in FIG. 24 locking member 126 terminates in generally downwardly projecting flange 142 which is adapted to enter the opening of the associated female locking element prior to initiating locking action. This downward projection of the male locking element flange facilitates initial indexing of the cover with respect to the base in order to facilitate subsequent locking of the cover and base. In a similar manner, locking elements 128, 130 and 132 preferably have downwardly projecting flanges and adjacent straight terminating flange portions such as 139, 141.

Figure 23:
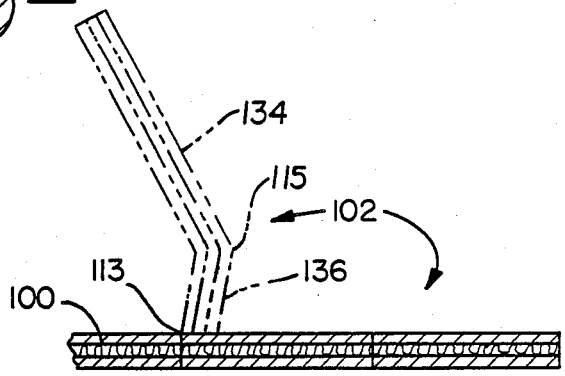
FIG. 23 is a side elevational view of the locking element of FIG. 20 shown in both locked (chain line) and unlocked positions.

FIG. 23 shows female locking element 102 in both an unlocked, flat position which is coplanar with base 100, and also in locked position. As shown, hinge pivotal axis 113 allows female locking element 102 to be pivoted upward and out of the plane of the remainder of the base. Additionally, pivotal axis 115 allows end portion 134 to be pivoted, from the plane of the remainder of the base, a further angular extent than lower portion 136.

FIG. 24 shows the cooperating relationship between female locking member 102 and male locking number 126 when those two members lock the cover 124 and base 100 together. Female element 102 is pivoted out of the plane of base 100 initially along hinged pivotal axis 115 and subsequently by hinge 113. As upward movement of female locking element 102 is initiated, outer section 134 will rotate upwardly about axis 115 to cause the inner edge (line 116) of the opening to move upwardly along the incline plane created by the sloped outer surface 125 of male locking element 126. Continued upward movement of the female locking element 102 will cause rotation about axis 113 to occur, thereby enlarging the radius of rotation of the female locking member 102. After the female locking member 102 has line or edge 116 pass over apex 138 the lock will be established. The inherent resiliency of the base material and the compound hinge action create a spring back action which helps secure the elements in locked position. Reversal of this sequence permits unlocking. It will be appreciated that the sequential compound hinge action facilities the efficient locking and unlocking action.

It is preferred to provide means to facilitate hinge 115 bending before hinge 113 bends. As is shown in FIG. 21 hinge 115 is of lesser extent than hinge 113. This facilitates the desired sequential hinge action. Alternately or in addition to such construction, hinge 115 may be created by scoring hinge 115 deeper than hinge 113.

By employing two hinged pivotal axes, 113 and 115, this snapback locking arrangement will facilitate the secure locking of cover 124 to base 100. Additionally, the inclusion of two hinged pivotal axes aids in rotating female locking element 102 in locking position, as it allows top edge 116 to be easily lifted over edge 138 without the need for stretching or pulling female element 102.

Also shown, in FIG. 24, is flange portion 142 which projects outwardly and downwardly from the lower vertical portion of male locking member 126, to fit into opening 110 in female locking member 102 to prevent movement and rotation of the cover 124 before locking.

It will be appreciated, therefore, that the present invention provides a simple and economic means of effecting a sanitary, accident resisting bakery food package which is firmly locked and yet is readily unlocked. All of this is accomplished without the need for employing separate locking elements or materials.

While for simplicity of disclosure generally circular packages have been shown, it will be appreciated that other shapes, such as rectangular or square for example, may be employed.

Whereas particular embodiments of the invention have been described above for the purpose of illustration, it will be appreciated by those skilled in the art that numerous variations of the details may be made without departing from the invention described in the appended claims.

We claim:

1. A bakery foods package comprising
a base for supporting the bakery food,
a separate cover removably secured to said base,
said cover having a top wall and a depending sidewall,
a plurality of circumferentially spaced first locking means formed within the lower portion of said cover sidewall,
a plurality of circumferentially spaced second locking elements formed in said base,
said first locking means being removably engaged with said second locking elements to lock said cover to said base, when said cover and said base are in a predetermined fixed relative position,
each of said second locking elements including at least two hinge means about which portions of said second locking elements may rotate,
said first locking means include male locking means,
said second locking means include female locking elements,
said base having at least two said female locking elements,
said female locking elements being integrally formed,
said female locking elements having portions projecting generally upwardly and inwardly to engage said male locking elements,
said hinge means having a first hinge spaced from and parallel to a second hinge,
said second locking elements having a free end and an end connected to the remainder of said base,
said first hinge disposed intermediate said second hinge and said free end, said first hinge having first pivot means,
said second hinge having second pivot means, and
said first pivot means being weaker than said second pivot means, whereby when said second locking elements are moved from unlocked position, into locking position said first hinge will bend before said second hinge, whereby said cover and said base will securely support said bakery food.

2. The bakery foods package of claim 1 including
said first pivot means of lesser axial extent from said second pivot means.

3. The bakery foods package of claim 1 including
said first pivot means being of lesser thickness than said second pivot means.

4. The bakery foods package of claim 2 including
said first pivot means being of lesser thickness than said second pivot means.

5. The bakery foods package of claim 4 including
said cover sidewall having a generally outwardly projecting lower flange.

6. The bakery foods package of claim 5 including
said cover sidewall flange having portions terminating in a generally downwardly direction, whereby free relative sliding movement of said base with respect to said cover is resisted.

7. The bakery foods package of claim 6 including
each said female locking element having a generally unobstructed opening when said female locking elements are in unlocked position.

8. The bakery foods package of claim 7 including
said cover sidewall flange having generally straight outwardly projecting portions adjacent said first locking means.

9. The bakery foods package of claim 8 including
the circumferential spacing between said female locking elements being substantially equal, and
the circumferential spacing between said male locking means being substantially equal.

10. The bakery foods package of claim 8 including
said base being corrugated board, and
said cover being plastic.

11. The bakery foods package of claim 8 including
said male locking means having portions which project through said opening defined by said second locking elements.

12. The bakery foods package of claim 11 including
said female locking elements having a portion spaced radially inwardly from the outer periphery of said lower flange of said cover when said female locking elements are in locking position.

13. The bakery foods package of claim 11 including
said cover and said base being of such size as to receive a cake.

14. The bakery foods package of claim 10 including
a foil layer secured to the upper surface of said base.

15. The bakery foods package of claim 11 including
said female locking elements of said base extending further outwardly than the remaining portion of said base when said female elements are in unlocked position and a portion of said female elements extending further inwardly than the remaining portion of said base when said female elements are pivoted in locking position.

16. The bakery foods package of claim 15 including
said engagement between said female locking elements and said male locking means serving to resist relative rotational movement in both directions between said cover and said base.

* * * * *